United States Patent [19]

Carlander

[11] 4,373,334

[45] Feb. 15, 1983

[54] DEVICE FOR VARIABLE HEIGHT ADJUSTMENT OF SUPPORTS

[76] Inventor: Lars E. Carlander, Kransvägen 112, Borås, Sweden, 502 51

[21] Appl. No.: 190,211

[22] Filed: Sep. 25, 1948

[30] Foreign Application Priority Data

Sep. 26, 1979 [SE] Sweden ..... 7907974

[51] Int. Cl.[3] ..... B60T 7/02; F01B 3/00

[52] U.S. Cl. ..... 60/594; 92/33; 92/71; 92/13.6

[58] Field of Search ..... 92/31, 33, 71, 147, 92/13.6; 60/594

[56] References Cited

U.S. PATENT DOCUMENTS

| | | | |
|---|---|---|---|
| 3,724,210 | 4/1973 | Kobashi et al. | 60/594 |
| 3,732,783 | 5/1973 | Emenaker | 92/33 |
| 3,766,835 | 10/1973 | Kobelt | 92/13.3 |
| 3,828,655 | 8/1974 | Williams | 92/31 |
| 4,030,404 | 6/1977 | Meijer | 92/147 |

FOREIGN PATENT DOCUMENTS 163833 9/1933 Switzerland .

*Primary Examiner*—Paul E. Maslousky
*Assistant Examiner*—Ali I. Tangoren
*Attorney, Agent, or Firm*—Holman & Stern

[57] ABSTRACT

An adjustment means for variable height adjustment of hydraulically or pneumatically operable supports, e.g. legs on tables, chairs, beds etc., adjustment means for simultaneously raising and lowering all supports and for separately adjusting each of said supports to suit the contour of the floor surface or similar foundation comprised of pressure chambers (13) in the housing (11) of the adjustment means (10), the number corresponding to the number of supports, each pressure chamber having a piston (14), which by way of an adjusting screw (15) cooperates with a driving nut (16), which is unrotatably but axially displaceably arranged in the housing. The driving nut is displaced by means of a threaded spindle (17) which is rotatably but undisplaceably mounted in the housing.

2 Claims, 3 Drawing Figures

DEVICE FOR VARIABLE HEIGHT ADJUSTMENT OF SUPPORTS

FIELD OF THE INVENTION

The present invention relates to an adjustment means for variable height adjustment of hydraulically or pneumatically operable supports, e.g. legs to vertically adjustable tables, chairs, beds etc.

DESCRIPTION OF THE PRIOR ART

Ergonomic demands especially in the working life have resulted in constructive solutions for adapting tools, office furniture, beds etc. to individual needs. Thus vertically adjustable chairs and tables for offices and beds with vertically adjustable legs for hospitals have been developed. These technical problems have mainly been solved by mechanical means and especially for tables and beds with four legs, that have to be raised and lowered simultaneously, the mechanical means have been complicated, heavy and bulky. In cases where pneumatic or hydraulic devices have been used for raising and lowering several legs simultaneoulusly, this has entailed motor-driven pumps or simiar devices requiring a power source, usually an electromotor. These devices are also complicated and expensive and can only be used where electricity is available.

BRIEF SUMMARY OF THE INVENTION

The object of the invention is to provide a simple, reliable and manually operable adjustment means, by which a plurality of supports can be raised and lowered simultaneously and by which each of said supports is vertically adjustable separately to suit the contour of the floor surface or similar foundation.

This has been achieved by the fact that said adjustment means comprises a number of pressure chambers, the number corresponding to the number of supports, a piston being arranged in each pressure chamber, each piston being arranged to cooperate with a driving nut, which is unrotatably but axially displaceably arranged in the housing of the adjustment means, said driving nut being displaceable by means of a threaded spindle which is rotatably but undisplaceably mounted in said housing.

DESCRIPTION OF AN EMBODIMENT

Figure 1:
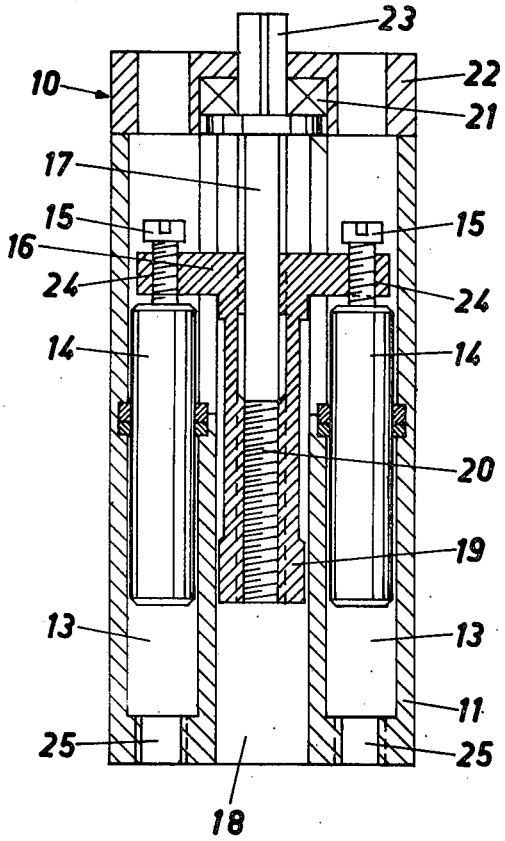
FIG. 1 is a longitudinal section through an adjustment means according to the invention.
Figure 2:
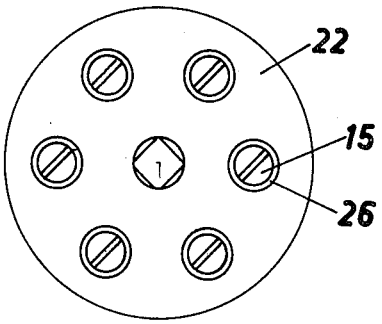
FIG. 2 is an end view of the adjustment means according to FIG. 1 seen from above.

The adjustment means 10 according to the invention comprises a housing 11 provided with a central bore 18. Radially outside the central bore 18 there are arranged pressure chambers 13, the number corresponding to the number of supports, i.e. legs 12, a piston 14 being arranged in each pressure chamber. A guide 19 is axially displaceable in the central bore 18, said guide at its upper end passing into a driving nut 16, which is unrotatably but axially displaceably guided in the housing 11. The driving nut 16 as well as the guide 19 are sleeve shaped and provided with internal threads 20 for receiving a threaded spindle 17, which is mounted in a cover

22 provided with thrust bearings 21 and attached to one end of the housing 11. The threaded spindle 17 is provided with a holder 23 for connection to a crank 32 or a motor if desired, said holder projecting outside the cover 22. The driving nut 16 has in alignment with each piston 14 a threaded bore 24 for an adjusting screw 15, said adjusting screws with their screw ends cooperating with the end portions of the respective piston 14. Each pressure chamber 13 is provided with an outlet opening 25 designed as a hose connection. In the cover 22 aligned with the adjusting screws 15 there are arranged holes 26, through which a screw driver or the like can be introduced for adjusting the screws 15.

Figure 3:
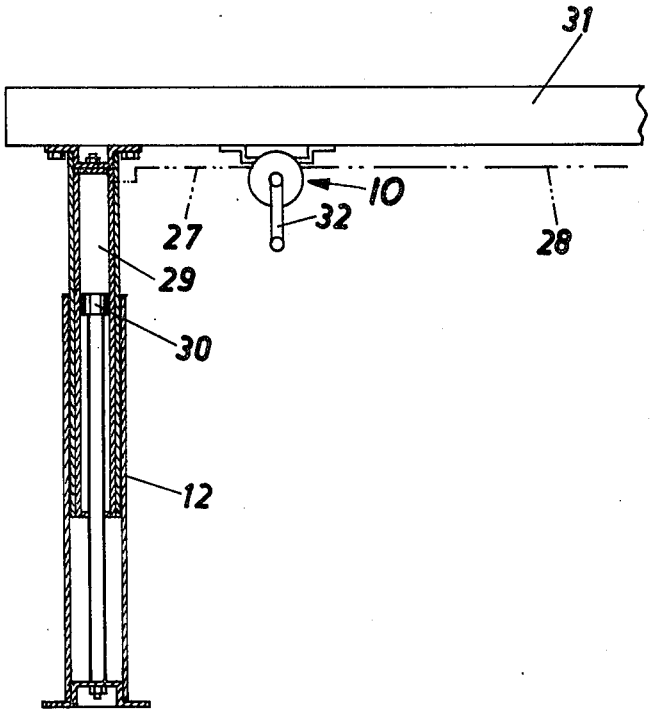
FIG. 3 shows a part of a table or the like with a section of a supporting leg and the adjustment means arranged on the underside of the table top.

As can be seen from FIG. 3 the adjusment means 10 is attached to a suitable place on the table or other object to be raised and lowered and in the embodiment shown it is attached to the underside of a table top.

Hydraulic conduits 27 and 28 etc are connected to the hose connections 25 of the adjustment means, said conduits with their opposite ends being connected to the plus side of a cylinder 29 and piston 30 arranged in a leg 12.

When adjusting the length of the legs 12 the screw spindle 17 is rotated by means of the crank 32, so that the driving nut 16 is axially displaced in one direction. The pistons 14 are then either pressed downwards towards the hose connections 25 or are displaced in the opposite direction by the pressure from the weight of the table 31 exerted on the end surface of the pistons 14 remote from the adjusting screws 15.

If the floor surface on which the legs 12 rest is uneven the table or the like can be adjusted to suit the contour of the floor by adjusting the pistons 14 by means of the adjusting screws 15. Each leg 12 can thus be adjusted and in such cases where certain legs shall have a length exceeding the length of the others, e.g. for providing a certain inclination of e.g. a table top, this can also be achieved by means of said adjusting screws 15.

The invention is not limited to the embodiment shown but a plurality of modifications are possible within the scope of the claims. It is e.g. obvious that the adjustment means can have more but also fewer pressure chambers 13 with pistons 14.

What I claim is:

1. An adjustment means for variable height adjustment of fluid pressure operable supports, e.g. legs to vertically adjustable tables, chairs, beds etc., comprising, a cylindrically shaped housing member, a central bore in said housing and coaxial therewith, a number of individual cylindrical pressure chambers within said housing radially spaced outwardly with respect to and extending parallel to said central bore and circumferentially spaced equidistantly with respect to each other, the number corresponding to the number of supports, a piston in each pressure chamber adapted for reciprocation therein, a driving nut unrotatably but axially displaceably mounted in the housing, said axial displacement being parallel to the reciprocation of said pistons, an internally screw threaded bore in said driving nut, a screw threaded spindle rotatably mounted in the housing, said screw threaded bore and spindle being in operative engagement so that rotation of said spindle axially displaces said driving nut, an individual adjusting screw for each piston threadedly mounted in said driving nut so that the inner end of each screw operatively engages one end of the respective piston, an elongated sleeve shaped guide member on said driving nut having an internal screw thread thereon cooperatively engaging the screw threads on said spindle, said guide member extending coaxially in said central bore from said nut between said pressure chambers and being guided for axial displacement in said central bore, means for connecting said spindle to a drive means, and a connection means in said housing communicating with each pressure chamber at the other end of each piston to facilitate connecting each pressure chamber by a conduit means to one of said fluid pressure operable supports so that when so connected with said conduit means, pressure chambers and supports containing a fluid pressure medium, rotation of said spindle will displace said pistons axially in said cylinders to operate said supports and said individual adjusting screws can operate each piston with respect to each other and each respective support with respect to the other supports.

2. The adjustment means as claimed in claim 1 wherein said means for connecting said spindle to a drive means comprises a coaxial extension on the end of said spindle extending through the end of said housing, a thrust bearing for said extension between said spindle and said end of said housing, and access holes for said adjusting screws extending through said end of said housing radially spaced outwardly with respect to said extension, each access hole being substantially coaxial with one of said adjusting screws and extending through said housing in communication with the head of said screw.

* * * * *

UNITED STATES PATENT AND TRADEMARK OFFICE

CERTIFICATE OF CORRECTION

PATENT NO. : 4,373,334

DATED : February 15, 1983

INVENTOR(S) : Lars E. Carlander

It is certified that error appears in the above—identified patent and that said Letters Patent is hereby corrected as shown below:

On the title page:

"[22] Filed: Sep. 25, 1948"

should be

-- [22] Filed: Sep. 24, 1980 --

Signed and Sealed this

*Thirty-first* Day of *May 1983*

[SEAL]

*Attest:*

DONALD J. QUIGG

*Attesting Officer*

*Acting Commissioner of Patents and Trademarks*